US007033225B2

(12) United States Patent
Belanger, Jr.

(10) Patent No.: US 7,033,225 B2
(45) Date of Patent: Apr. 25, 2006

(54) MULTIPURPOSE POWER POINT FOR VEHICULAR USE

(75) Inventor: Thomas D. Belanger, Jr., Saline, MI (US)

(73) Assignee: Ford Global Technologies, LLC, Dearborn, MI (US)

( * ) Notice: Subject to any disclaimer, the term of this patent is extended or adjusted under 35 U.S.C. 154(b) by 0 days.

(21) Appl. No.: 10/710,545

(22) Filed: Jul. 20, 2004

(65) Prior Publication Data

US 2005/0153602 A1 Jul. 14, 2005

Related U.S. Application Data

(60) Provisional application No. 60/536,209, filed on Jan. 13, 2004.

(51) Int. Cl.
*H01R 24/04* (2006.01)

(52) U.S. Cl. ..... 439/668

(58) Field of Classification Search ..... 439/166, 439/170, 218, 668, 669; 219/265, 267, 264
See application file for complete search history.

(56) References Cited

U.S. PATENT DOCUMENTS

| | | | | | |
|---|---|---|---|---|---|
| 2,310,029 | A * | 2/1943 | Kline | 219/264 |
| 2,630,517 | A * | 3/1953 | Hiscar | 219/266 |
| 3,462,581 | A * | 8/1969 | Boudreau et al. | 219/267 |
| 3,643,062 | A * | 2/1972 | Ohinata | 219/265 |
| 3,760,150 | A * | 9/1973 | Fenn et al. | 219/265 |
| 3,845,925 | A * | 11/1974 | Edwards | 248/27.1 |
| RE31,452 | E * | 11/1983 | Fenn et al. | 219/265 |
| 4,449,036 | A * | 5/1984 | Seibel et al. | 219/265 |
| 4,500,774 | A * | 2/1985 | Honjo | 219/265 |
| 4,544,226 | A * | 10/1985 | Lupoli et al. | 439/551 |
| 6,538,236 | B1 * | 3/2003 | Rostan | 219/267 |

* cited by examiner

*Primary Examiner*—Tulsidas C. Patel
*Assistant Examiner*—Harshad C Patel
(74) *Attorney, Agent, or Firm*—Artz & Artz, P.C.; Gary A. Smith

(57) ABSTRACT

A multipurpose power point for use by, and accessible to, the driver or other occupant of a vehicle, includes a generally cylindrical terminal housing having center terminal and at least one detent for retaining a ignitor plug within the terminal housing. An overtravel preventer attached to an outer housing portion of the power point engages the detent and subjects the detent to a radially inwardly directed force sufficient to prevent the detent from deforming plastically in response to forces placed upon the detent by power consuming devices inserted into the terminal housing.

5 Claims, 4 Drawing Sheets

MULTIPURPOSE POWER POINT FOR VEHICULAR USE

This application claims the benefit of U.S. Provisional Application No. 60/536,209, filed Jan. 13, 2004.

BACKGROUND OF INVENTION

1. Field of the Invention

The present invention relates to a power point for providing, in the context of a vehicle, electrical power, accessible to the driver or other passenger, for powering such devices as an ignitor plug or an accessory power plug supplying a device such as a telephone, a light, or other electrical or electronic devices.

2. Disclosure Information

Cigarette or cigar lighter sockets have been used for many years in vehicles, in conjunction with an ignitor plug which is inserted in the socket and heated. With the advent, however, of a veritable plethora of electrical and electronic devices intended to be driven by the low voltage electrical systems of vehicles via the lighter socket, cigarette lighter sockets have assumed a dual role, with perhaps the more important part of the duality being the powering of various electronic devices. Accessory power plugs used with various electrical and electronic devices typically have a body made of plastic, with metallic center and side electrodes. The side electrodes are frequently made very robust, and, unfortunately, the use of such accessory power plugs sometimes deforms the detent mechanisms mounted within lighter sockets to a point at which the cigarette or cigar lighter will not be properly retained within the socket.

The present invention solves the problems with maintaining the structural integrity of detents used to retain an ignitor plug within a vehicular cigarette or cigar lighter, while nevertheless permitting the use of accessory power plugs having side terminals incorporated therein.

SUMMARY OF INVENTION

A multipurpose power point for use by, and accessible to, the occupants of a vehicle, includes a generally cylindrical terminal housing having an open end and a closed end, and a center terminal located within the terminal housing at the closed end. The center terminal is adapted for making contact with a power consuming device inserted into the terminal housing. At least one detent is provided, with the detent having a first end attached to the terminal housing and a second end adapted for subjecting a power consuming device inserted into the terminal housing to both radially and axially directed forces. An overtravel preventer, attached to an outer housing portion of the power point, engages the detent and subjects the detent to a radially inwardly directed force sufficient to prevent the detent from deforming plastically in response to an opposing force placed upon the detent by a power consuming device. In this manner, the retention or detenting capability of the detent with respect to an ignitor plug will be properly maintained during the useful life of the vehicle.

According to one aspect of the present invention, an outer housing of the multipurpose power point is generally cylindrical and coaxial with the terminal housing. An overtravel preventer according to the present invention may comprise an integral formed rib extending axially along an inner portion of the outer housing such that the rib will contact one of the previously described detents, so as to limit deflection of the detent in response to forces imposed upon the detent by the power consuming device. As an alternative, the overtravel preventer may include a simply supported, integral ribbon extending axially along, but radially separated from a detent, with the integral ribbon having a section profile which matches the section profile of the detent. As yet another alternative, the overtravel preventer may include an integral cantilevered ribbon extending axially along but radially separated from the detent.

According to another aspect of the present invention, the outer housing may include a generally cylindrical ring adapted for mounting a power point within a panel, such as an instrument or dash panel, with the overtravel preventer including an integral formed rib extending axially along an inner portion of the generally cylindrical ring such that the rib will contact a detent so as to limit deflection of the detent in response to forces imposed upon the detent by a power consuming device inserted to the generally cylindrical terminal housing.

An overtravel preventer according to the present invention may alternatively include an inwardly extending stop upset from the outer housing, with the stop being either fully attached to the outer housing or partially separated from the outer housing. In any event, the overtravel preventer is structured so as to engage one or more detents formed in the generally cylindrical terminal housing and thereby subject the detent to a radially inwardly directed force sufficient to prevent the detent from deforming plastically in response to radially directed force imposed upon the detent by a combination terminal and retention contact mounted to the side of an accessory power plug.

The present inventive power point allows the powering of devices other than cigarette lighters, without impairing the function of the cigarette lighter itself.

Other advantages, as well as objects and features of the present invention, will become apparent to the reader of this specification.

DETAILED DESCRIPTION

Figure 1:
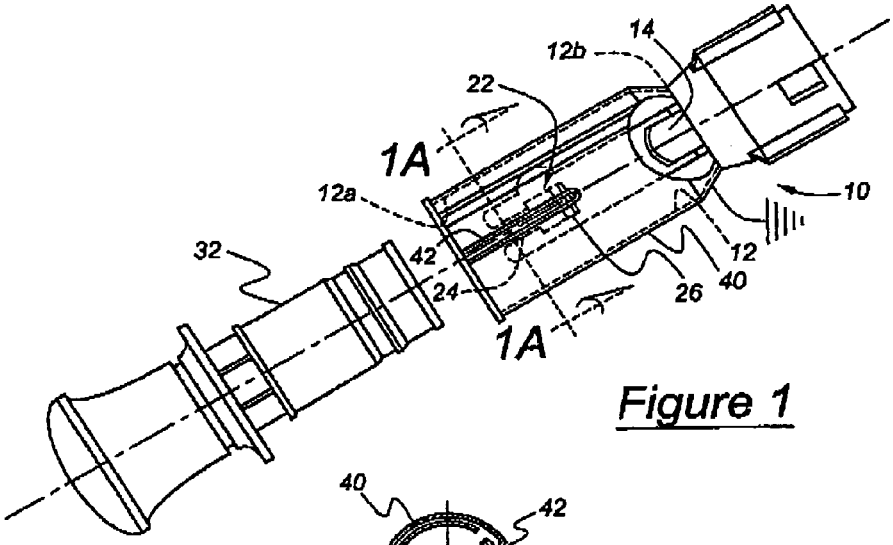
FIG. 1 is a perspective view of a multipurpose power point according to the present invention showing an ignitor plug for use with the power point.

As shown in FIG 1, multipurpose power point 10 includes a generally cylindrical terminal housing 12 having an open end 12*a* and a closed end 12*b*. Center terminal 14, which is conventionally a positive terminal, and which is wired to the vehicle's electrical system in conventional fashion, is located within terminal housing 12. Center terminal 14 is available to engage either an igniter plug, 32, or an accessory power plug 34 (shown in FIG. 2 with a prior art terminal housing).

Figure 1A:
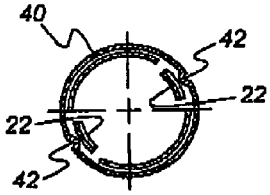
FIG. 1A is a sectional view of the multipurpose power point of FIG. 1, taken along the line 1A—1A of FIG. 1.
Figure 2:
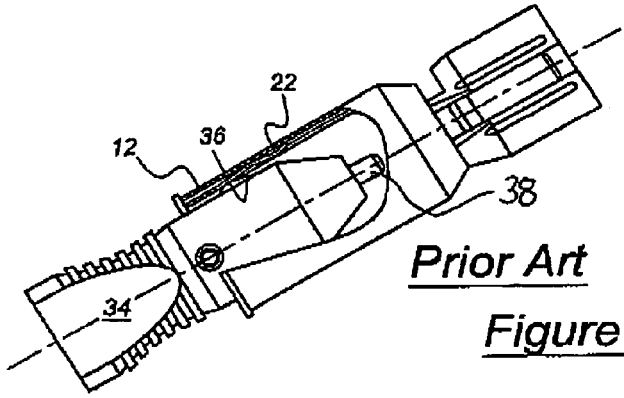
Prior Art Figure 2
FIG. 2 illustrates a prior art power point and a typical accessory power plug in use today.

As shown in FIG. 2, accessory power plug 34 has at least one side terminal and retention contact 36 extending from the body of the power plug. Center electrode 38 projects from an end of power plug 34. In many cases, contact 36 will cause unprotected detent or lance 22 to deform plastically, or colloquially, bend, radially outwardly to the point where ignitor plug 32 cannot be retained within generally cylindrical terminal housing 12. This problem is solved as shown in FIGS. 1 and 1A through the use of one or more ribs 42 which are integral with outer housing 40 and which extend axially along an inner portion of outer housing 40 such that rib 42 will contact latch portion 26 of detent 22, so as to prevent spring portion 24 of detent 22 from deforming plastically and thereby losing its ability to retain ignitor plug 32 within terminal housing 12. In essence, rib 42, which is a first embodiment according to present invention, subjects detent or lance 22 to a radially inwardly directed force sufficient to prevent the detent from deforming plastically in response to an opposing force placed upon the detent by a power consuming device, whether it be an ignitor plug 32 or more likely, an accessory power plug 34. Rib 42 may be linear or may be formed so as to approximate the section profile of detent 22.

Figure 3:
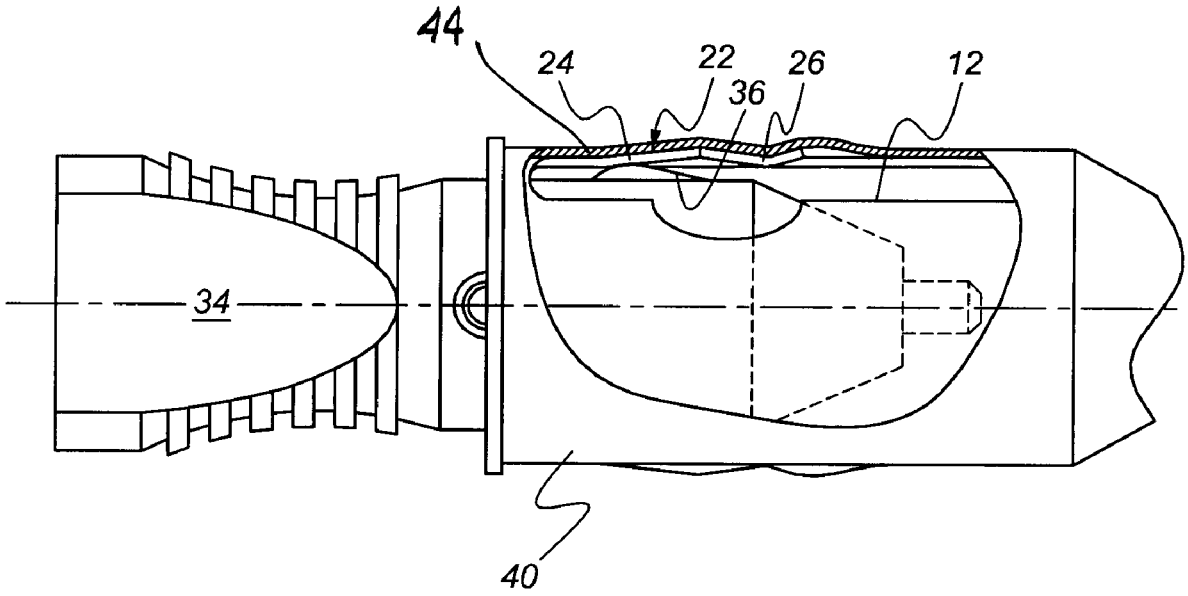
FIG. 3 illustrates a cut-away multipurpose power point according to the present invention having an accessory power plug inserted therein.

FIG. 3 illustrates a preferred embodiment according to the present invention in which an overtravel preventer includes ribbon 44 which is simply supported by outer housing 40. Being simply supported, ribbon 44 is attached at each of its ends to outer housing 40, but is separated at its sides from outer housing 40. Ribbon 44 extends axially along, but radially separated from, lance or detent 22 except when power plug 34 has been inserted into power point 10.

Figure 5:
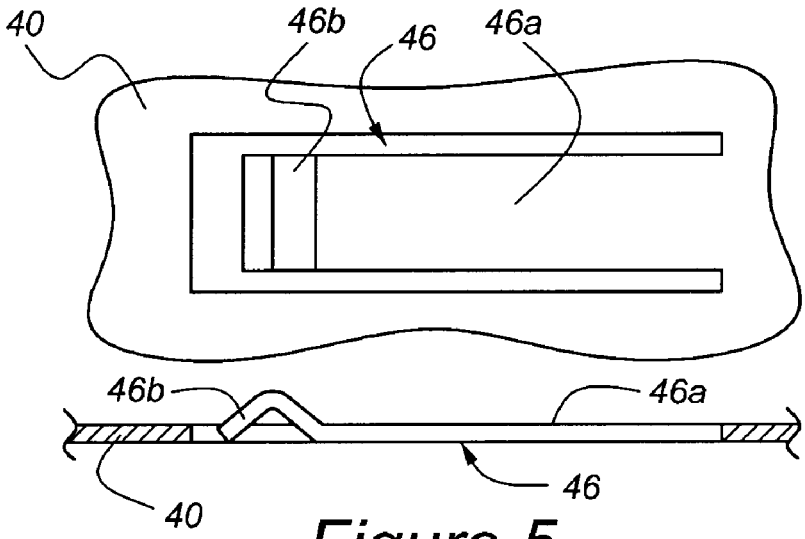
FIGS. 5, 6, 7, 8 and 9 illustrate various overtravel preventers formed in an outer housing of a multipurpose power point according to the present invention.

FIG. 5 illustrates a second ribbon type of overtravel preventer, 46, having a spring portion 46*a* and a detent portion 46*b*. The ribbon of FIG. 5 differs from that shown in FIG. 3 inasmuch as ribbon 46 is cantilevered from outer housing 40. In addition to spring portion 46*a*, ribbon 46 has a latch portion 46*b*.

Figure 6:
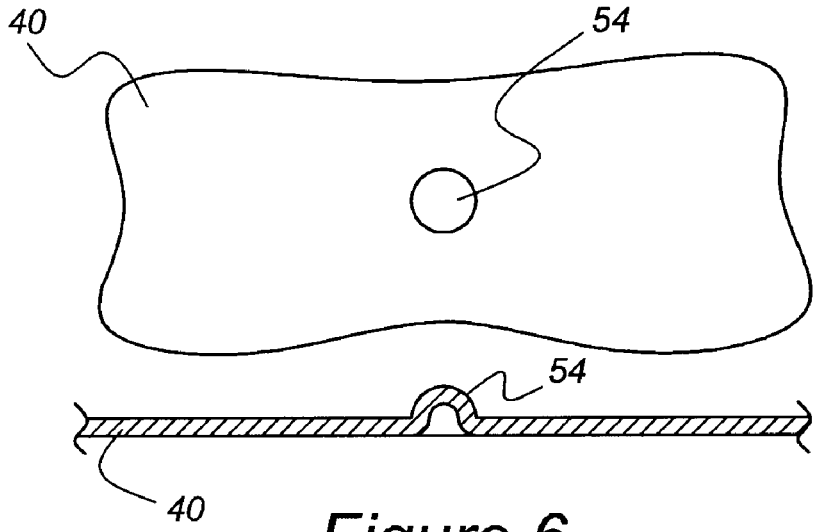
Figure 7:
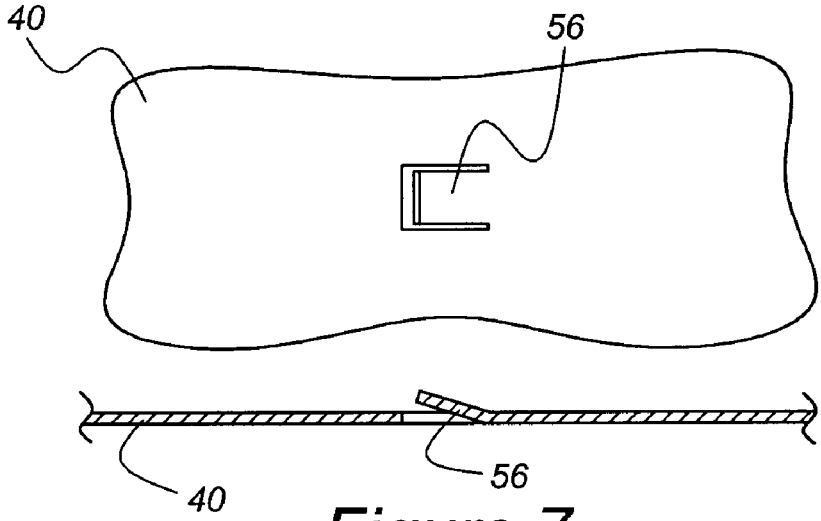
Figure 8:
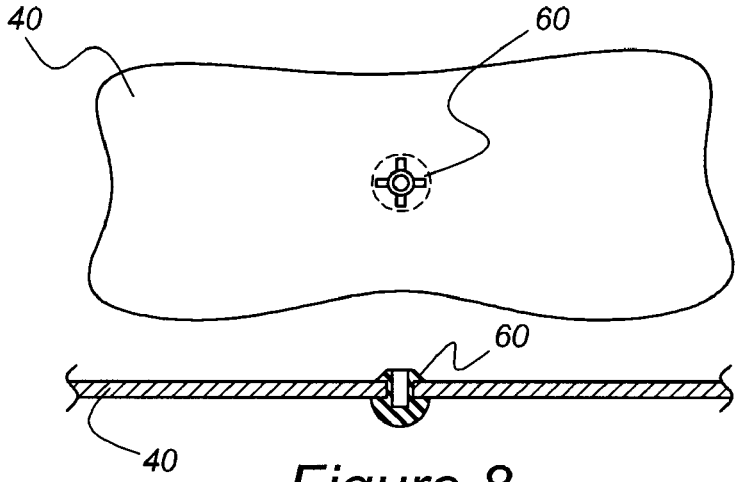

FIG. 6 illustrates an embodiment in which stop 54 is upset from outer housing 40. FIG. 7 shows similar stop, except that the stop 56 of FIG. 7 is partially detached from outer housing 40. FIG. 8 illustrates a self-retaining insert which could, for example comprise a metallic or non metallic rivet or other type of barbed fastener known to those skilled in the art and suggested by this disclosure.

Figure 9:
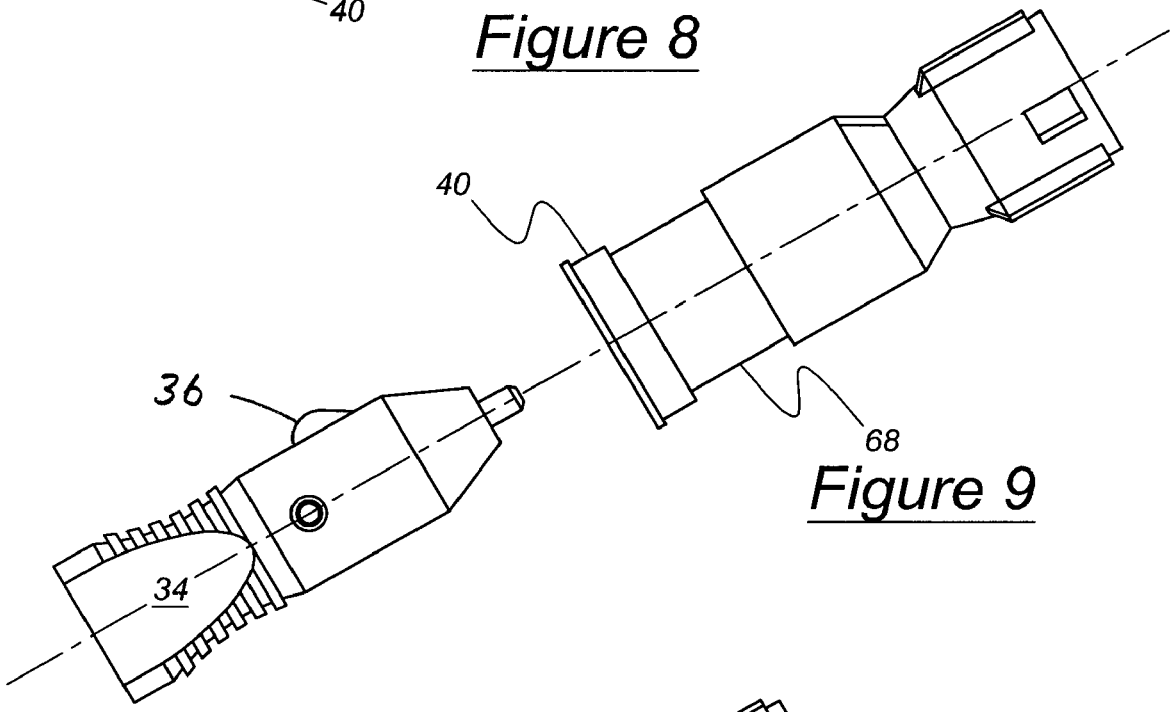

FIG. 9 illustrates an overtravel preventer, 68, formed as a necked-down segment extending axially for a portion of outer housing 40.

Figure 10:
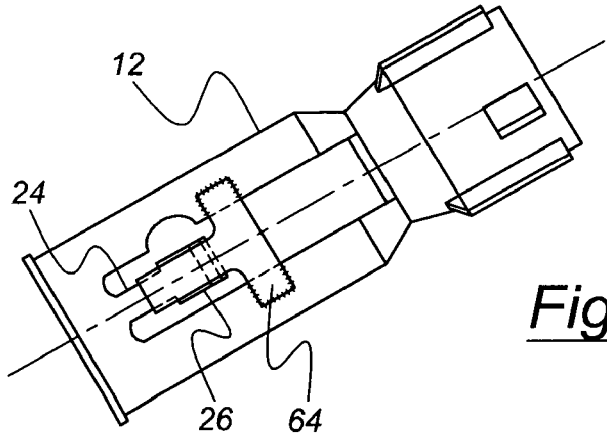
FIG. 10 illustrates an overtravel preventer attached directly to the terminal housing of a multipurpose power point according to the present invention.

FIG. 10 illustrates an embodiment of the present invention in which an overtravel preventer includes ribbon 64 which is welded directly to the outer cylindrical surface of terminal housing 12. This overtravel preventer may be employed without an outer housing.

Figure 4:
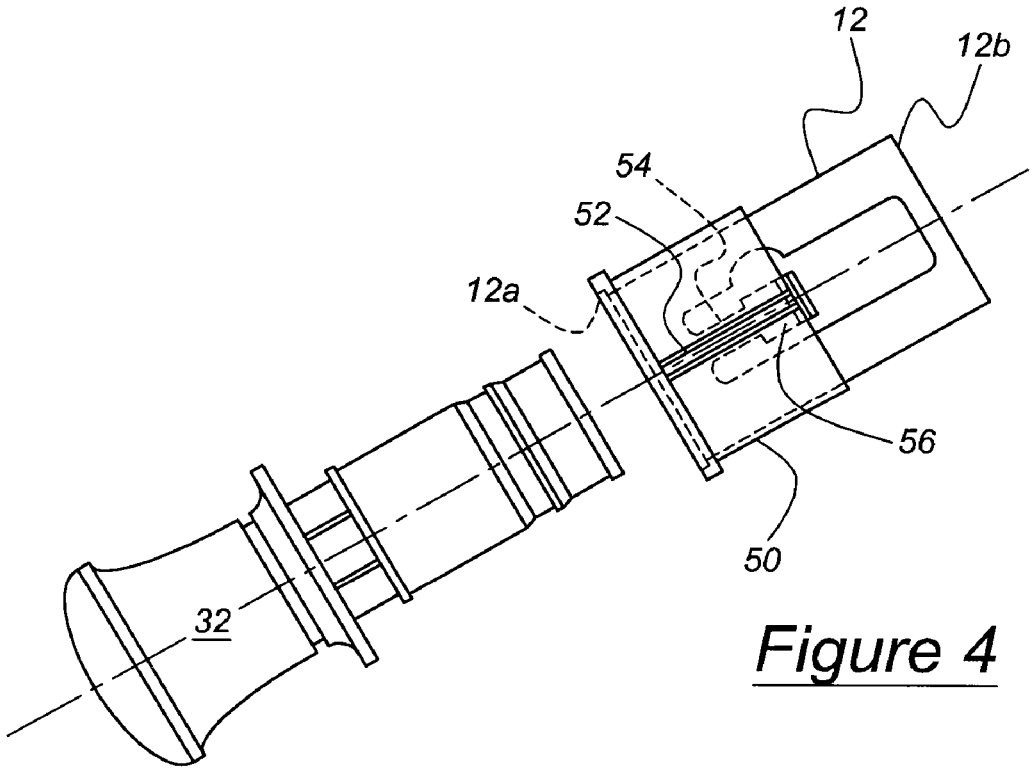
FIG. 4 illustrates another embodiment of a mounting device for a power point according to the present invention.

FIG. 4 illustrates an embodiment in which a ring, 50, which is generally cylindrical, is adapted for attaching power point 10 to a panel of a vehicle, such as an instrument panel. The embodiment of FIG. 4 also has an inwardly upset axially extending rib, 52, which buttresses detent latch portion 56, so as to prevent plastic deformation of spring portion 54 in the previously described manner.

Although the present invention has been described in connection with particular embodiments thereof, it is to be understood that various modifications, alterations, and adaptations may be made by those skilled in the art without departing from the spirit and scope of the invention set forth in the following claims.

The invention claimed is:

1. A multipurpose power point accessible by the occupant of a vehicle, comprising:

a generally cylindrical terminal housing having an open end and a closed end;

a center terminal, located within said terminal housing at said closed end, with said center terminal being adapted for making contact with a power consuming device inserted into said terminal housing;

at least one detent having a first end attached to said terminal housing and a second end adapted for subjecting a power consuming device inserted into said terminal housing to both radially and axially directed forces; and an overtravel preventer, attached to an outer housing portion of said power point, for engaging said at least one detent and for subjecting said detent to a radially inwardly directed force sufficient to prevent said detent from deforming plastically in response to an opposing force placed upon the detent by said power consuming device, with said overtravel preventer comprising an inwardly extending stop upset from said outer housing and positioned so as to prevent outward movement of said detent beyond a predetermined position.

2. A multipurpose power point according to claim 1, wherein said power consuming device comprises an ignitor plug.

3. A multipurpose power point according to claim 1, wherein said power consuming device comprises an accessory power plug adapted to be wired to an electrically powered device.

4. A multipurpose power point according to claim 1, wherein said outer housing is generally cylindrical and coaxial with said terminal housing, with said overtravel preventer comprising an integral formed rib extending axially along an inner portion of said outer housing such that said rib will contact said detent so as to limit deflection of said detent in response to forces imposed upon the detent by said power consuming device.

5. A multipurpose power point accessible by the occupant of a vehicle, comprising:

a generally cylindrical terminal housing having with an open end and a closed end;

a center terminal, located within said terminal housing at said closed end, with said center terminal being adapted for making contact with a power consuming device inserted into said terminal housing;

at least one detent having a first end attached to said the terminal housing and a second end adapted for subjecting a power consuming device inserted into said the terminal housing to both radially and axially directed forces; and an overtravel preventer, attached to an outer surface of said the terminal housing, with said overtravel preventer engaging said the at least one detent and subjecting said detent to a radially inwardly directed force sufficient to prevent said the detent from deforming plastically in response to an opposing force placed upon the detent by said the power consuming device, wherein said overtravel preventer comprises a ribbon having a first end attached to an outer surface of said terminal housing and a second end for engaging said at least one detent.

* * * * *